United States Patent [19]

Brown et al.

[11] 4,425,506

[45] Jan. 10, 1984

[54] STEPPED GAP ACHROMATIC BENDING MAGNET

[75] Inventors: Karl L. Brown, Menlo Park; William G. Turnbull, Cupertino; Phillip T. Jones, Los Altos, all of Calif.

[73] Assignee: Varian Associates, Inc., Palo Alto, Calif.

[21] Appl. No.: 323,010

[22] Filed: Nov. 19, 1981

[51] Int. Cl.[3] ..... G21K 1/08; H01J 3/32

[52] U.S. Cl. ..... 250/396 ML

[58] Field of Search ..... 250/396 ML, 396; 378/137

[56] References Cited

U.S. PATENT DOCUMENTS 3,629,578 12/1971 Le Poole .

4,322,622 3/1982 Tronc ..... 250/396 ML

*Primary Examiner*—Alfred E. Smith

*Assistant Examiner*—Jack I. Berman

*Attorney, Agent, or Firm*—Stanley Z. Cole; Leon F. Herbert; Edward H. Berkowitz

[57] ABSTRACT

A first order achromatic magnetic deflection system for use in conjunction with a charged particle accelerator, is realized from a stepped gap manget wherein a charged particle propagated through the system is subject to at least two adjacent homogenous magnetic fields in traversing one-half of a symmetric trajectory through the system.

12 Claims, 5 Drawing Figures

STEPPED GAP ACHROMATIC BENDING MAGNET

FIELD OF THE INVENTION

The present invention is in the general area of charged particle beam optics and transport and particularly relates to achromatic beam deflection especially suitable for use in radiation treatment apparatus.

BACKGROUND OF THE INVENTION

Achromatic optical elements are essential in commercial and medical therapeutic irradiation systems because the primary attribute for such operations is the relatively high beam intensity and control thereof. A typical high beam current accelerator, such as the microwave linear accelerator, achieves the required beam intensities but the energy distribution is rather wide. In order to utilize the available beam it is therefore necessary to introduce optical lements which are relatively insensitive to the energy distribution of the beam. In particular it is desirable for x-ray apparatus to concentrate an intense beam onto a small beam spot on the x-ray target to obtain an x-ray source sufficiently small in relationship to the targeted irradiation region.

Beam deflection systems in commercial irradiation and medical therapy applications are ordinarily subject to mechanical and geometrical constraints incident to the maneuverability of the apparatus, shielding and collimation of irradiation flux and as well as economic considerations in the construction of such apparatus.

One achromatic beam deflection system of the prior art is described in U.S. Pat. No. 3,867,635 commonly assigned with the present invention. In this apparatus the beam traverses three uniform field sector magnets and two intermediate drift spaces, undergoing a 270° deflection for incidence upon the x-ray target. The sector magnet poles are precisely specified in regard to the sector angles. The angles of incidence and egress of the beam with respect to each sector and a shunt of complex shape occupies the intermediate spaces as well as the entrance and exit regions of the deflector to assure required field free drift spaces. The mutual internal alignment of all components of the deflector is essential to achieve the performance of this prior art device as well as is the alignment of the assembled deflector with the accelerator beam.

Another prior art system is known from U.S. Pat. No. 3,379,911 wherein 270° deflection is accomplished in a uniform field to which there is introduced in the vicinity of the deflection midpoint (135°) a gradient region, such that the magnetic field in this gradient region increases radially in the plane of deflection toward the outer portion of accepted trajectories. Thus, those trajectories characterized by a large radius of curvature (in the absence of a gradient) are subject to a somewhat more intense field than would be the trajectories for smaller radii of curvature. Proper adjustment of the gradient shim yields first order achromatic deflection through the desired angle.

It is desirable in all of the described systems for the deflector to introduce no substantial momentum dispersion of the beam and to produce at the exit plane a faithful reproduction of conditions encountered at the entrance plane of the system.

SUMMARY OF THE PRESENT INVENTION

The principal object of the present invention is the provision of an especially simple first order achromatic deflection system in a charged particle irradiation apparatus.

In one feature of the invention, a deflection magnet comprises a first uniform field region separated from a second uniform field region along a boundary, whereby particle trajectories traversing said first region are characterized by a large radius of curvature in said first region, a smaller radius of curvature in said second region, thence again traversing said first region with said large radius of curvature.

In another another feature of the invention the ratio of fields in said first and second regions is a constant and is realized by first (wide) and second (narrow) gaps between stepped pole faces.

In still another feature of the invention the boundary between said first and second regions is a straight line.

In yet another feature of the invention, energy selection slits are disposed in the relatively narrow gap of said second field region whereby radiation from said slits is more effectively shielded by a greater mass of said magnetic pole-pieces in said second (narrow gap) field region.

In still another feature of the invention, precise bending plane alignment of the deflection magnet with the axis of a particle accelerator is accomplished by a rotation of the magnet about an axis through the bending plane thereof without need for internal alignment of components of said magnet.

In again another feature of the invention the magnitude of displacement of trajectories from the central orbit at the image plane of the magnet is equal to the displacement of the trajectory from the central orbit at the entrance plane of the magnet, whereby parallel rays at the entrance plane are rendered parallel at the exit plane.

Other features and advantages of the present invention will become apparent upon perusal of the following specification taken in conjunction with the accompanying drawings.

In still yet another feature of the invention, a single quadrupole element is employed to cause a radial waist and a transverse waist in an achromatic charged particle beam deflection system to occur at a common target plane.

DETAILED DESCRIPTION OF THE INVENTION

Figure 1:
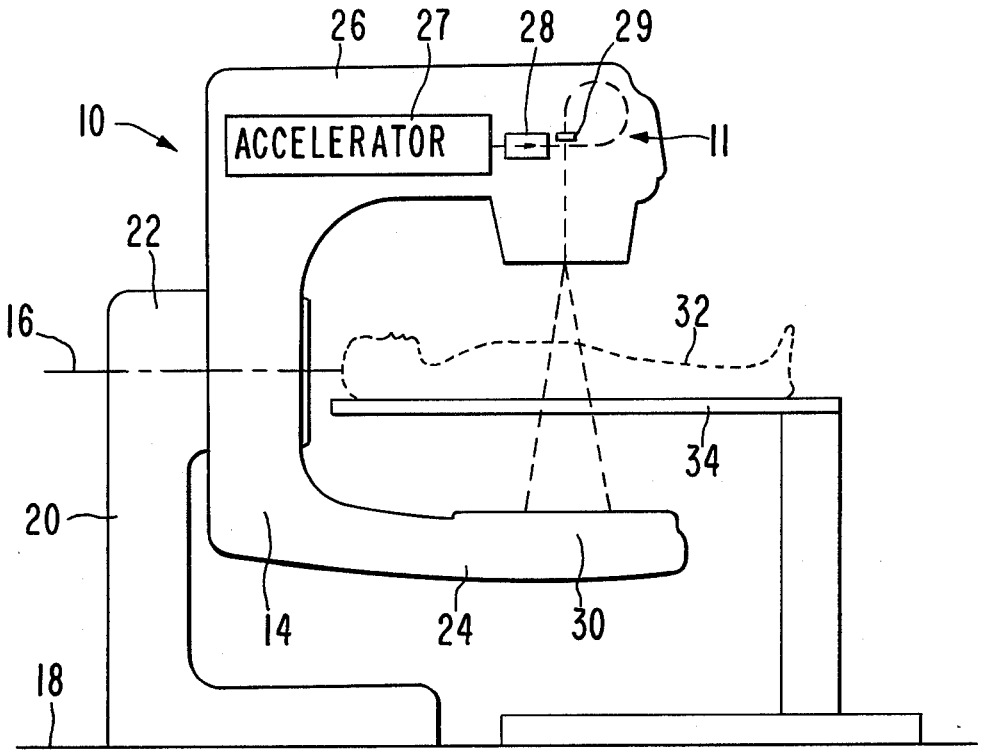
FIG. 1 is a schematic side elevational view of an x-ray therapy machine employing features of the present invention.

FIG. 1 shows an x-ray therapy machine 10 incorporating a magnetic deflection system 13. The therapy machine 10 comprises a generally C-shaped rotatable gantry 14, rotatable about an axis of revolution 16 in the horizontal direction. The gantry 14 is supported from the floor 18 via a pedestal 20 having a trunnion 22 for rotatably supporting the gantry 14. The gantry 14 includes a pair of generally horizontally directed parallel arms 24 and 26. A linear electron accelerator 27 communicating with quadrupole 28 is housed within arm 26 and a magnetic deflection system 11 and target 29 are disposed at the outer end of the horizontal arm 26 for projecting a beam of x-rays between the outer end of the arm 26 and an x-ray absorbing element 30 carried at the outer end of the other horizontal arm 24. The patient 32 is supported from couch 34 in the lobe of the x-rays issuing from target 28 or theraputic treatment.

Figure 2:
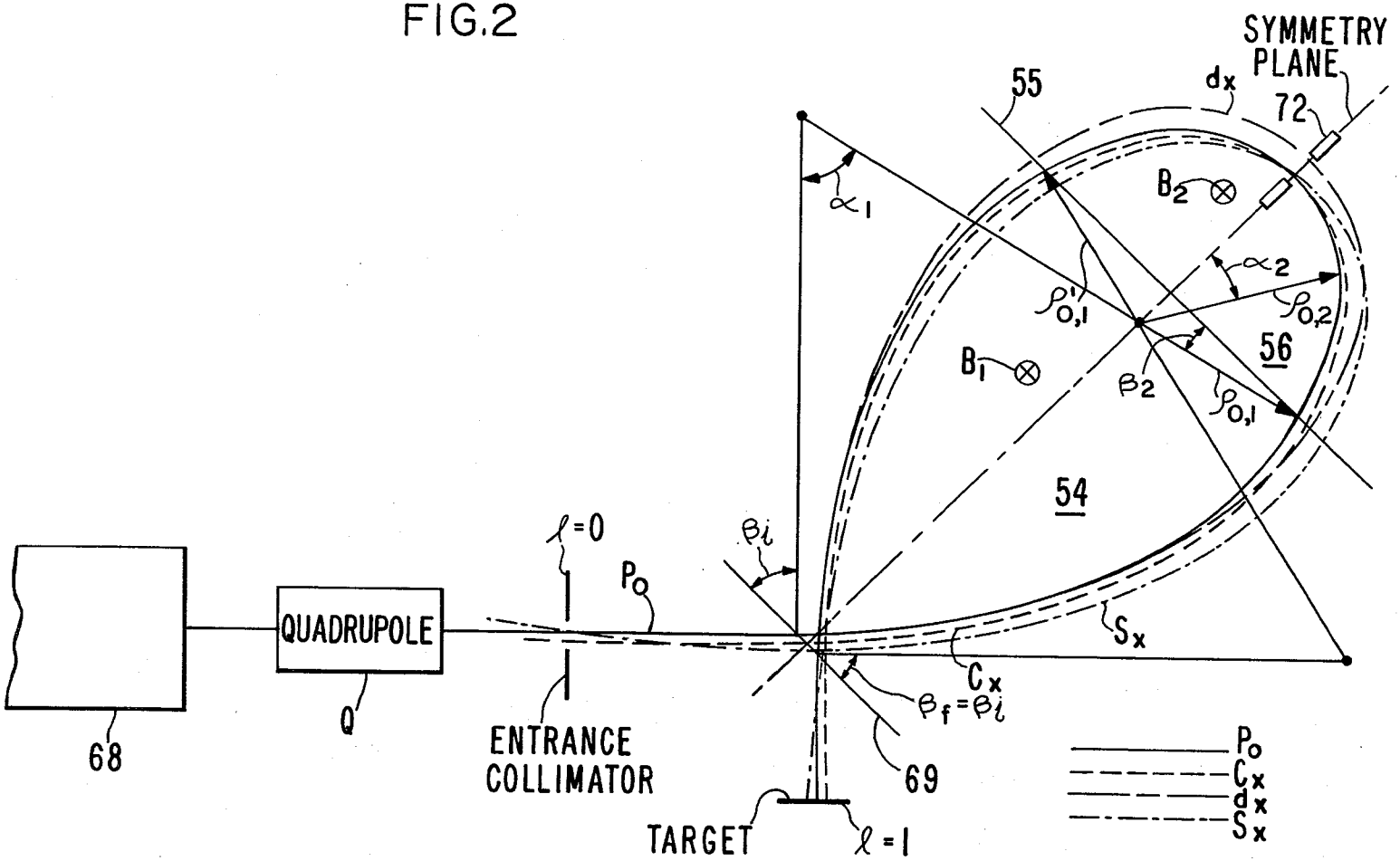
FIG. 2 is a view of representative trajectories in the bending plane of the present invention.
Figure 3A:
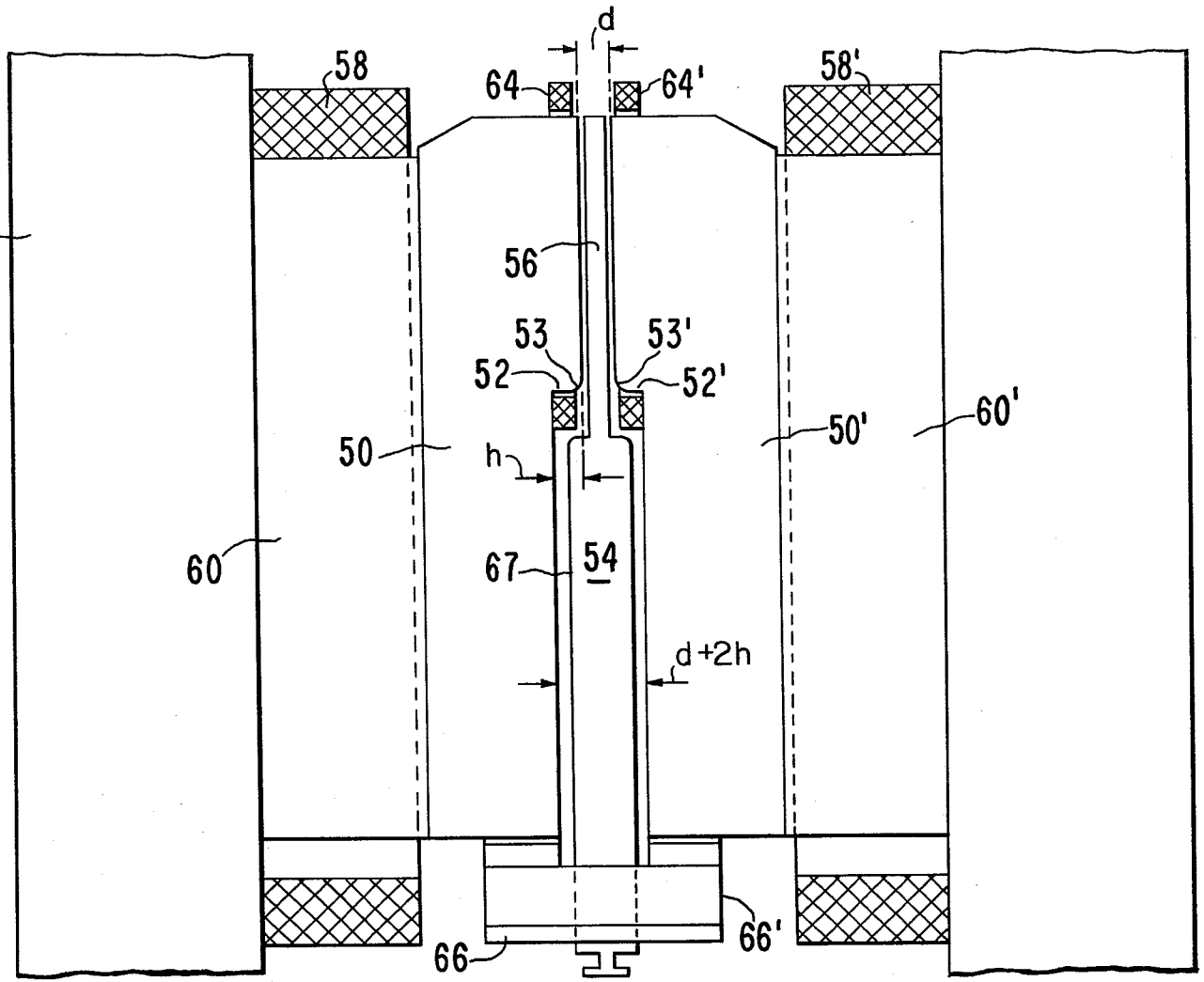
FIG. 3A is a sectional view (perpendicular to the bending plane) through the magnet including the pole cap of FIG. 2.
Figure 3B:
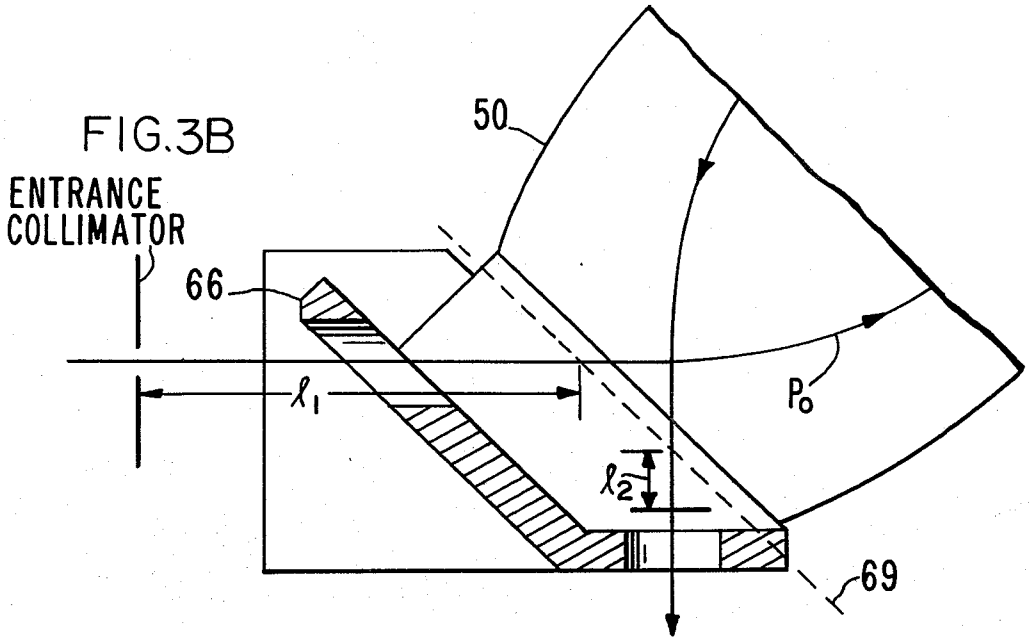
FIG. 3B shows the field clamp of the preferred embodiment.

Turning now to FIGS. 2 and 3, a pole cap 50 of the polepiece of the invention is shown. A step 52 divides pole cap 50 into regions 54 and 56, the pole cap 50 in region 56 having a greater thickness than region 54 by the height h of the step 52. Consequently, the magnet comprising pole cap 50 and 50′ is characterized by a relatively narrow gap of width d in the region 56 and a relatively wide gap (d+2h width) in the region 54. Accordingly, the magnet comprises a constant uniform region 54 of relatively low magnetic field and another constant uniform region 56 of relatively high magnetic field. Excitation of the magnet is accomplished by supplying current to axially separated coil structure halves 58 and 58′ each disposed about respective outer poles 60 and 60′ to which the pole caps 50 and 50′ are affixed. The magnetic return path is provided by yoke 62. Trim coils 64 and 64′ provide a vernier to adjustment of the field ratio in the regions 54 and 56.

A vacuum envelope 67 is placed between the poles of the magnet and communicates with microwave linear accelerator cavity 68 through quadrupole Q.

As discussed below, another important design parameter is the angle of incidence of the trajectory with respect to the field at the entrance of the deflector. The control of the fringing field to maintain the desired position and orientation of the outer virtual field boundary 69 with respect to the entrance region is accomplished with field clamp 66 displaced from the pole caps by aluminum spacer 66′. In similar fashion, the location of the exit field boundary and orientation is controlled by suitable shape and position of the field clamp 66 in this region.

An interior virtual field boundary 55 may be defined with respect to step 52 by appropriate curvature of the stepped surfaces 53 and 53′. This curvature compensates for the behavior of the magnetic field as saturation is approached and controls the fringing field in this region. Such shaping is well known in the art.

Neither field boundary 69 nor 55 constitutes well defined locii and each is therefore termed "virtual" in accord with convention. A parameter is associated with each virtual field boundary to characterize the fringing field behavior in the transition region from one magnetic field region to another. Thus a parameter $K_1$ is a single parameter description of the smooth transition of the field from the entrance drift space $l_1$ to region 54 along a selected trajectory, as for example, central orbit $P_0$ (and between region 54 and the exit drift space $l_2$ in similar fashion). The fringing field parameter $K_2$ describes similar behavior between magnetic field regions 54 and 56.

It is conventional in the discussion of dipole magnetic optical elements for the z axis of the coordinate system to be chosen tangent to a reference trajectory with origin $z=0$ at the entrance plane and $z=1$ at the exit plane. (The entrance and exit planes are, in general, spaced apart from the magnetic field boundaries by drift spaces as indicated and should not be identified with any field boundary). The x axis is selected as the displacement axis in the plane of deflection of the bending plane. The y axis then lies in the transverse direction to the bending plane. The y axis direction is conventionally called "vertical" and the x axis, "horizontal".

In the plane of deflection, a central orbital axis labeled $P_0$ is described by a particle of reference momentum arrow $P_0$. It is desired that displaced trajectories $C_x$ and $C_y$ having initial trajectories parallel to $P_0$(in the bending plane and transverse thereto, respectively), produces a like displacement at the exit of the deflector. A trajectory that enters this system at an angle $\beta_i$ to the field boundary exits at an angle $\beta_f$. In the present discussed embodiment it is desired that $\beta_i=\beta_f=\beta$. The trajectory is characterized by a radius of curvature $\rho_1$ in the region 54 of the magnet due to magnetic field $B_1$. In the region 56, the corresponding radius of curvature is $\rho_2$ due to the magnetic field $B_2$. The notation $\rho_{0,1}$ (see FIG. 2) refers to the radius of curvature of the reference trajectory $P_0$ in the low field region. The line determined by the respective centers for radii of curvature $\rho_0$, 1 and $\rho_0$, 2 intersects the virtual field boundary 55 determining the angle of incidence $\beta_2$ to region 56 (incoming) and from symmetry the angle of incidence through field boundary 55 as the trajectory again enters region 4. For simplicity, the 0 subscript will be deleted. The deflection angle in the bending plane in the region 54 (incoming) is $\alpha_1$ and again an angle $\alpha_1$ in the outgoing trajectory portion of the same field region 54. In the high field region 56 the particle is deflected through a total angle $2\alpha_2$ for a total deflection angle $\chi=2(\alpha_1+\alpha_2)$ through the deflection system. It is a necessary and sufficient condition for an achromatic deflection element that momentum dispersive trajectory $d_x$ (initial central trajectory direction, having a magnitude of $P_0+\Delta P$) is dispersed and brought to parallelism with the central trajectory $P_0$ at the midpoint deflection angle $\alpha_1+\alpha_2$, that is, at the symmetry plane. Further, the trajectory of particles initially displaced from, and parallel with trajectory $P_0$ (in the bending plane) are focused to a cross-over with trajectory $P_0$ at the symmetry plane. These trajectories are known in the art as "cosine-like" and designated $C_x$, where the subscript refers to the bending plane. Trajectories of particles initially diverging from trajectory $P_0$ (in the bending plane) at the entrance plane of the magnet are shown in FIG. 2. These trajectories are known in the art as "sine-like" and are labeled as $S_x$ in the bending plane. The condition of maximum dispersion and parallel-to-point focussing occurs at the symmetry plane and therefore defining slits 72 are located in this plane to limit the range of momentum, angular divergence accepted by the system. In common with similar systems, these slits 72, which are secondary sources of radiation, are remote from the target and shielded by the polepieces of the magnet. In the present invention, the gap is narrower in precisely this region, wherefore the greater mass of the polepieces 50 and 50' more effectively shield the environment from slit radiation.

Trajectories $C_y$ and $S_y$ refer to cosine-like and sine-like trajectories in the vertical (y-z) plane.

It is therefore required to obtain the relationship of the radii of curvature $\rho_1$ and $\rho_2$ and therefore, the magnetic fields $B_1$ and $B_2$ for the parameters of $\alpha_1$ and $\alpha_2$, $P_0$, and the field extension parameters $K_1$ and $K_2$ of the virtual field boundaries subject to the condition of zero angular divergence in the bending plane of the momentum dispersive trajectory at the symmetry plane, e.g., $(\partial d_x/\partial \theta)=0$ for deflection angle $\chi/2$. From this condition, imposed at the symmetry plane, it can be shown that $d_x$ and its divergence, $d_x'$ will vanish at the exit of the magnet.

Figure 4:
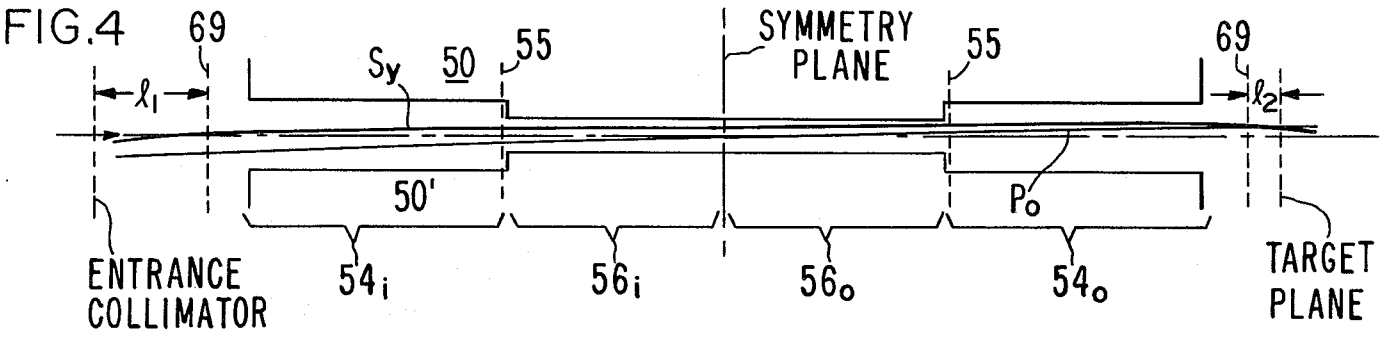
FIG. 4 shows the transverse projected trajectories unfolded along the entire central trajectory.

In a simple analytical treatment of the problem, transfer matrices through the system are written for the incoming trajectory through region 54, proceeding to the incoming portion of region 56 to the symmetry plane, and then outgoing from region 56 to the boundary with region 54 and again outgoing through region 54. These matrices for the bending plane are written as the matrix product of the transfer matrices corresponding to propagation of the beam through the four regions $\mathbf{54}_o$, $\mathbf{56}_o$, $\mathbf{56}_i$, $\mathbf{54}_i$ as shown in FIG. 4

Eq. 1

$$R_x = \begin{pmatrix} R_{11} & R_{12} & R_{13} \\ R_{21} & R_{22} & R_{23} \\ 0 & 0 & 1 \end{pmatrix} = \begin{pmatrix} C_x & S_x & d_x \\ C'_x & S'_x & d'_x \\ 0 & 0 & 1 \end{pmatrix}$$

$$= \begin{pmatrix} c_2 & s_2\rho_2 & \rho_2(1-c_2) \\ -\frac{s_2}{\rho_2} & c_2 & s_2 \\ 0 & 0 & 1 \end{pmatrix} \begin{pmatrix} 1 & 0 & 0 \\ -\frac{\beta_2}{\rho_2} & 1 & 0 \\ 0 & 0 & 1 \end{pmatrix}$$

$$\begin{pmatrix} 1 & 0 & 0 \\ \frac{\beta_2}{\rho_2} & 1 & 0 \\ 0 & 0 & 1 \end{pmatrix} \begin{pmatrix} c_1 & s_1\rho_1 & \rho_1(1-c_1) \\ -\frac{s_1}{\rho_1} & c_1 & s_1 \\ 0 & 0 & 1 \end{pmatrix}$$

where $c_1$, $s_1$, $c_2$, $s_2$, are a short notation for respectively, cosine $\alpha$ and sine $\alpha$ in the respective low (1) and high (2) field regions and $\beta$ here stands for tam $\beta$. The variables $\rho_1$ and $\rho_2$ refer to radii of curvature in the respective regions 1 and 2 corresponding to regions 54 and 56. The $C_i$ and $S_i$ parameters are conventionally expressed as displacements with respect to the reference trajectory. Equation 1 can be reduced to yield, in the bending plane Eq. 2

$$R_x = \begin{pmatrix} -1 & l(x) & d_x \\ 0 & -1 & \left[-\left(\frac{\rho_1}{\rho_2}\right)(1-c_1)(s_2+\beta c_2) + c_2(s_1+\beta_1)(1-c_1)+s_2\right] \\ 0 & 0 & 1 \end{pmatrix}$$

The matrix element $R_{11}$ expresses a coefficient describing the relative spatial displacement of the $C_x$ trajectory. The $R_{12}$ element describes the relative displacement of $S_x$. In similar fashion, the element $R_{21}$ element describes the relative angular divergence of $C_x$ and the element $R_{22}$ the relative angular divergence of the $S_x$ trajectory. Matrix elements $R_{13}$ and $R_{23}$ describes the displacement in the bending plane of the momentum dispersive trajectory $d_x$ (which was initially congruent with the central trajectory at the object plane) and $R_{23}$ describes its divergence. Several conditions are operative to simplify the optics: (a) the apparatus maps incoming parallel trajectories to outgoing parallel trajectories at the entrance and exit planes respectively, which follows from the matrix element $R_{21}=0$; (b) the deflection magnet having no dependence upon the sense of the trajectory from which it follows that $R_{22}=R_{11}$; (as is also apparent from consideration of the symmetry of the system); (c) the determinant of the matrix is identically 1 by Liouville's theorem. It follows from conditions (b) and (c) that $R_{11}==-1$.

The bottom row of the matrix describes the momentum in either plane. These elements are identically 0,0 and 1 because there is not net gain or loss in beam energy (momentum magnitude) in traversing any static magnet system.

For an achromatic system, the dispersion displacement term $R_{13}$ and its divergence, $R_{23}$ must be 0. As expressed above, the condition on $R_{23}$ at the symmetry plane is developed analytically to yield a relationship among certain design parameters of the system. As a result thereof one obtains the expression Eq. 3

$$d'_x = -\left(\frac{\rho_1}{\rho_2}\right)(1-c_1)(s_2+\beta c_2) + c_2 s_1 + c_2\beta(1-c_1) + s_2 = 0$$

which can be solved to yield the condition

Eq. 4

$$\frac{\rho_1}{\rho_2} = \frac{1 + s_1 s_2 c_2 - c_1 c_2^2}{1 - c_1}$$

Following conventional procedure the corresponding vertical plane matrices for the same regions 54 (incoming), 56 (incoming), 56 (outgoing), and 54 (outgoing) may be written and reduced to obtain the matrix equation for transverse plane propagation through the system.

$$\vec{y}(1) = R_y \vec{y}(0)$$

where 1 is the z coordinate location of the exit plane for the entrance plane, z=0. A principal design constraint is the realization of a parallel to parallel focusing in this plane is to be contrasted with the deflection plane where the corresponding condition follows from the geometry of the magnet.

Thus far the transfer matrices $R_x$ and $R_y$ describe the transfer functions which operate on the inward directed momentum vector $P(z_1)$ at the field boundary 69 to produce outgoing momentum vector $P(z_2)$ at the field boundary 69 after transit of the magnet. In the preferred embodiment, drift spaces $l_1$ and $l_2$ are included as entrance and exit drift spaces, respectively. Drift matrices of the form $$\begin{pmatrix} 1 & l_i \\ 0 & 1 \end{pmatrix}_{i=1,2}$$

operate on the $R_{x,y}$ matrices which both exhibit the form of equation 2, e.g., $$R_x = \begin{pmatrix} -1 & L_x \\ 0 & -1 \end{pmatrix}, R_y = \begin{pmatrix} -1 & L_y \\ 0 & -1 \end{pmatrix}$$

and it is observed that the magnet transfer matrix has the form of an equivalent drift space. Thus, the transformation through the total system with drift spaces $l_1$ and $l_2$ will yield total transfer matrices for the bending and transverse planes given by $$R_{xT,yT} = \begin{pmatrix} -1 & \mp L_{x,y} \\ 0 & -1 \end{pmatrix}$$

where the minus sign refers to the matrix $R_{xT}$ and the plus sign refers to $R_{yT}$. the lengths $L_x$ and $L_y$ are the distances from the exit plane to the projected crossovers of the $S_x$ and $S_y$ trajectories.

Figure 5:
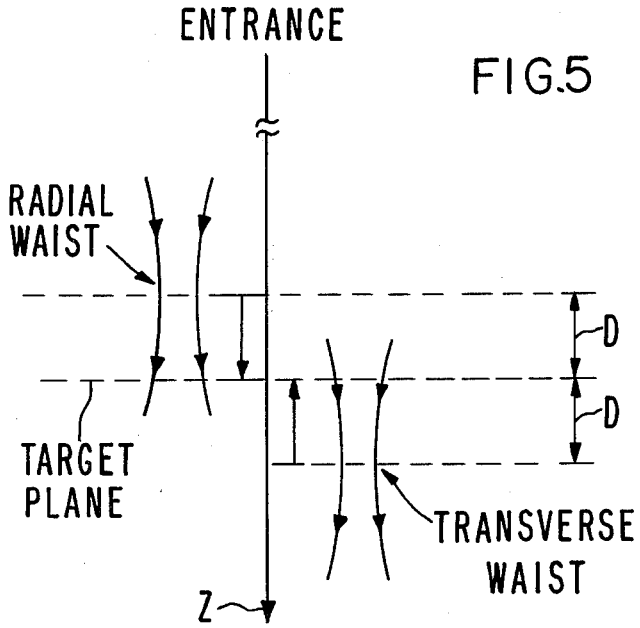
FIG. 5 shows the relationship of radial and transverse waists.

Turning now to FIG. 5, the general situation is shown wherein the waist in the bending or radial plane and the waist in the transverse plane are achieved at different positions on the z axis. Thus, in one plane the beam envelope is converging while diverging in another plane. Previously, a plurality of quadrupole elements would be arranged to bring these waists into coincidence at a common location z. In the present invention, the condition $d_x'=0$ and $C_y=0$ are satisfied at the symmetry plane with the result that $d_x=0$ at the field exit boundary. Moreover, it follows from this that $C_x$ characterizes parallel to parallel transformation through the magnet in the bending plane. In the transverse plane parallel to parallel transformation is imposed on the design. Consequently, the matrix describing either transverse or bending plane exhibits the form as given above. The effect of the quadrupole singlet at the entrance of the system takes the form $$RQ|_{x,y} = \begin{pmatrix} -1 & \mp L_T \\ 0 & -1 \end{pmatrix} \begin{pmatrix} 1 & 0 \\ \mp\left(\frac{1}{f_q}\right) & 1 \end{pmatrix} = \begin{pmatrix} -1 \mp \frac{L_T}{f_q} & \pm L_T \\ 0 & -1 \end{pmatrix}$$

where $s_q$ may be identified with the (variable) quadrupole focal length. The waist of the beam is attained from expressions of the form $$|x_{(1)}|^2 = |C_x X_{(o)}|^2 + |S_x X'_{(o)}|^2$$

$$|y_{(1)}|^2 = C_y y_{(o)}|^2 + |S_y Y'_{(o)}|^2$$

It is noted that $S_x$ and $S_y$ are unaffected by the quadrupole inasmuch as these trajectories exhibit zero amplitude, by definition, at z=0. The displacement of trajectories $C_y$ and $C_x$ are of opposite side. If the range $l_1+l_2$ has been properly selected the focal length of the quadrupole can be adjusted to bring the radial waist and transverse waist into coincidence.

The matrix equations $$\vec{X}_{(1)} = R_{xT}\vec{X}_{(o)}$$

$$\vec{y}_{(1)} = R_{yT}\vec{y}_{(o)}$$

which describe the total system including drift spaces in the vertical and bending planes are most conveniently solved by suitable magnetic optics programs, such as, for example, the code TRANSPORT, the use of which is described in SLAC Report 91 available from Reports Distribution Office, Stanford Linear Accelerator Center, P.O. Box 4349, Stanford, CA 94305. The TRANSPORT code is employed to search for a consistent set of parameters:

subject to selected input parameters, $\rho_1$, the radius of curvature of $P_0$ in region 54, $\rho_1/\rho_2$, the relative radius of curvature of $P_0$ in region 54 to the radius of curvature in region 56, $\beta_1$, the angular incidence of trajectory $P_0$ on virtual field boundary, $\alpha_2$, the angular rotation of the central trajectory $P_0$ in the high field region which also determines $\beta_2$ the angle of incidence of $P_0$ on the interior virtual field boundary, $\alpha_1$, the rotation of the reference trajectory in the low field region, subject to the selected input parameters as follows:

$K_1$, the parameter of the virtual field boundary between the low field region and the external field free regions, $K_2/K_1$, the relative parameter describing the virtual interior field boundary between the high field and low field regions, For the preferred embodiment symmetry has been imposed, e.g., $\chi=2(\alpha_1+\alpha_2)$. In one representative set of design parameters for 270° electron deflection, the desired mean electron energy is variable between 6 Mev and 40.5 Mev. First order achromatic conditions are required over this range. The angle of incidence $\beta$ for entrance and exit portions of the trajectory is 45° and the outer virtual field boundary 69 is located at z=10 cm relative to the entrance collimator (z=0) aperture. The central trajectory rotates through an angle $\alpha_1$ of 41.5° under the influence of a magnetic field $B_1$ of 4.17 kilogauss and intercepts the interior virtual field boundary 55 at z=33.5 cm at an angle $\beta_2=90°-\alpha_2$ of $3\frac{1}{2}$° to reach the symmetry plane at z=37.4 cm and continued rotation through the angle $\alpha_2$ (93.5°) under the influence of magnetic field $B_2$ of 15.90 kilogauss. The trajectory is symmetric within the magnetic field boundaries and the target is located at beyond the outer virtual field boundary. At the entrance collimator the beam envelope is 2.5 mm in diameter exhibiting (semi cone angle) divergence properties in both planes of 2.4 mr.

The geometry of the magnet assures a parallel to parallel with deflection plane transformation. The condition that $d_x'=0$ at the symmetry plane provides momentum independence. The parallel to parallel condition in the transverse plane is therefore a constraint. The bend angles $\alpha_1$ and $\alpha_2$ and the ratio of field intensities are varied to obtain the desired design parameter set.

It has been found that a first order achromatic deflection system for a deflection angle of 270° can be achieved with a variety of field ratios ($B_1/B_2$) as shown from equation 3.

Further, absolute values of corresponding matrix elements for both the horizontal and vertical planes can be obtained which are very nearly the same, yielding an image beam spot which is symmetric.

One of ordinary skill in the art will recognize that other deflection angles may be accommodated by deflection systems similarly constructed. Moreover the interior field boundary may take the form of a desired curve if desired. Accordingly, the foregoing description of the invention is to be regarded as exemplary only and not to be considered in a limiting sense; thus, the actual scope of this invention is indicated by reference to the appended claims.

What is claimed is:

1. A charged particle accelerator irradiation machine for irradiating an object comprising:

(a) charged particle accelerator means for accelerating a beam of charged particles along a given axis, (b) a bending magnet system or bending said beam away from said axis through a deflection angle $\chi$ with respect to said given axis, said bending magnet system comprising, (1) a first uniform magnetic field region and adjacent thereto, a second uniform magnetic field region, said magnetic fields of first and second region in the same direction, the magnetic field of said second region greater than the magnetic field in said first region, said first region comprising a first field boundary remote from said second region and said first and second regions comprising a second field boundary, said second field boundary forming a straight line, (2) means for injecting said beam of charged particles into said first region through said first boundary at an angle $\beta_i$ with respect to said first boundary in the plane of deflection whereby said beam is deflected through an angle with respect to said first boundary in the plane of deflection whereby said beam is deflected through an angle $\alpha_1$ in the deflection plane into said second region and thence through said second boundary at an angle $\beta_2$ therewith and again deflected through an angle 2 $\alpha_2$ in said second region to again enter said first region whereby said beam is deflected through an additional angular interval $\alpha_1$, and (3) means for extracting said beam from said first region.

2. The irradiation machine of claim 1 wherein said first field boundary comprises a straight line.

3. The irradiation machine of claim 2 wherein said first field boundary is parallel to said second field boundary.

4. The irradiation machine of claim 3 comprising target means for production of penetrating radiation from the collision of said beam therewith.

5. The irradiation machine of claim 4 further comprising gantry means for rotating said machine along arcs through angles in each of two orthogonal planes passing through said object.

6. A first order achromatic deflection system for deflecting charged particles through a deflection angle $\chi$ comprising:

polepiece means comprising first and second pole caps disposed about a median plane for establishing at least contiguous first and second magnetic field regions, each said magnetic field region comprising a substantially homogeneous field.

7. The deflection system of claim 6 wherein said polepiece means comprising at least one step in the thickness of each said pole cap for establishing a field boundary between said magnetic field regions, the locus of said field boundary forming a straight line in the plane of each said pole cap.

8. The deflection system of claim 7 wherein said charged particles are incident upon said first magnetic field region through first field boundary at an entrance position, the direction of incidence substantially at an angle $|\beta|$ with said field boundary, whereby a desired focal condition is obtained and whereby said charged particle momentum is rotated through an angle $\alpha_1$ in transiting said first magnetic field region.

9. The deflection system of claim 8 wherein said charged particles exiting said first region are concurrently incident upon said second region through second field boundary between first and second region at an angle $\beta_2$ at a first position on said boundary whereby another desired focal condition is attained and said charged particle momenta are rotated through an additional angle $\alpha_2$, said angle $\beta_2=90°-\alpha_2$.

10. The deflection system of claim 9 wherein said charged particles are rotated through an additional angular increment $\alpha_2$ to again intercept said second boundary at an angle having the magnitude $|\beta_2|$ and re-enter said first region at a position spaced apart from said first position along said second boundary whereby a third focal condition is achieved.

11. The deflection system of claim 10 wherein said charged particles are again rotated through yet an additional angular increment of magnitude $\alpha_1$ whereby the total angular deflection $\chi=2(\alpha_1+\alpha_2)$ is achieved and said charged particle momentum exits said first field region at an exit position along said first field boundary, said exit position spaced apart from said entrance position and at an angle $\beta$ with respect to said first field boundary.

12. The deflection system of claim 11 wherein said first and second field boundaries are parallel.

* * * * *